US008184055B2

(12) United States Patent
Liu et al.

(10) Patent No.: US 8,184,055 B2
(45) Date of Patent: May 22, 2012

(54) ELECTROMAGNETIC INPUT LCD MONITOR

(75) Inventors: Cheng-Lu Liu, Hsin-Chu (TW); Pei-Wei Lin, Hsinchu (TW); Sheng-Mao Lin, Tainan (TW)

(73) Assignee: Waltop International Corporation, Hsinchu (TW)

( * ) Notice: Subject to any disclaimer, the term of this patent is extended or adjusted under 35 U.S.C. 154(b) by 474 days.

(21) Appl. No.: 12/573,760

(22) Filed: Oct. 5, 2009

(65) Prior Publication Data

US 2010/0238073 A1 Sep. 23, 2010

(30) Foreign Application Priority Data

Mar. 17, 2009 (CN) ..... 2009 1 0129301

(51) Int. Cl.
*H01Q 1/24* (2006.01)

(52) U.S. Cl. ..... 343/702

(58) Field of Classification Search ..... 343/700 MS, 343/702, 795, 906
See application file for complete search history.

(56) References Cited

U.S. PATENT DOCUMENTS

| | | | | |
|---|---|---|---|---|
| 6,542,126 | B2 * | 4/2003 | Bahr et al. | 343/702 |
| 6,700,540 | B2 * | 3/2004 | Holshouser | 343/700 MS |
| 7,015,863 | B2 * | 3/2006 | Sadler et al. | 343/702 |
| 7,061,435 | B2 * | 6/2006 | Lin et al. | 343/702 |
| 7,518,568 | B2 * | 4/2009 | Tracy et al. | 343/873 |
| 8,081,119 | B2 * | 12/2011 | Kato et al. | 343/700 MS |
| 2008/0266201 | A1 * | 10/2008 | Tracy et al. | 343/873 |
| 2009/0002243 | A1 * | 1/2009 | Dahlstrom et al. | 343/702 |

* cited by examiner

*Primary Examiner* — Huedung Mancuso
(74) *Attorney, Agent, or Firm* — Squire Sanders (US) LLP

(57) ABSTRACT

An electromagnetic input LCD monitor is disclosed in this invention. The electromagnetic input LCD monitor includes a back frame and a film antenna module. The back frame has at least one opening. The film antenna module includes a film antenna plate and a signal receiving module. The film antenna plate is disposed on a surface of the back frame; the signal receiving module is disposed on the other surface of the back frame. The film antenna plate has a wiring portion which is connected with the signal receiving module through the opening.

10 Claims, 4 Drawing Sheets

ELECTROMAGNETIC INPUT LCD MONITOR

BACKGROUND OF THE INVENTION

1. Field of the Invention

The present invention generally relates to an LCD monitor, and more particularly, to an electromagnetic input LCD monitor.

2. Description of the Prior Art

FIG. 1A shows a film antenna module 100. The film antenna module 100 includes a film antenna plate 110 and a signal receiving module 120. The film antenna plate 110 includes wiring area 111, routing area 112, and at least one flexible flat cable (FFC) 113. The circuit of the film antenna plate 110 is made of conductive material, and the conductive material can be silver paste. Because the electrical resistance of the circuit made of silver paste is higher, it is necessary to design the width of the circuit wider. It is also necessary to dispose the routing area 112 besides the wiring area 111 for routing the circuit.

The film antenna plate 110 is able to sense an electromagnetic device so as to perform an input process. The film antenna plate 110 is connected with the signal receiving module 120 by the flexible flat cable 113. The flexible flat cable 113 can be connected with signal receiving module 120 by a connector 130. The signal receiving module 120 includes at least one chip 121 wherein signals of the film antenna plate 110 are processed by the chip 121.

FIG. 1B and FIG. 1C show a rear view and a sectional view of a back frame 200 of a conventional LCD monitor respectively. The back frame 200 is made of a metal material, and side frames 210 are disposed on the edge of the back frame 200. The side frames 210 are formed by a metal bending process. The side frames 210 are used for increasing the strength of the back frame 200, and the side frames 210 are able to be fixed on an outer frame of the conventional LCD monitor by screws.

FIG. 1D and FIG. 1E show a sectional view and a rear view of the film antenna module 100 which is disposed on the back frame 200. The film antenna plate 110 of the film antenna module 100 is disposed on one surface of the back frame 200. The routing area 112 and the flexible flat cable 113 are bended to the other surface of the back frame 200, and the signal receiving module 120 is also fixed on this surface. The back frame 200 is able to prevent the signal receiving module 120 from being interfered by the electromagnetic signals of the lamp of the conventional LCD monitor.

In order to prevent the routing area 112 of the film antenna plate 110 from being damaged by the side frame 210, it is necessary to remove the side frame 210 disposed near the routing area 112. However, because of the removing of the side frame 210, the strength of the back frame 200 is decreased, the strength of the back frame 200 may be not enough. The electromagnetic signals of the lamp of the conventional LCD monitor may reach the signal receiving module 120, and the signal receiving module 120 may be interfered by the electromagnetic signals of the lamp of the conventional LCD monitor.

For the reason that there are some disadvantages of the prior art mentioned above, there is a need existed to propose a novel electromagnetic input LCD monitor, wherein the back frame of the electromagnetic input LCD monitor has enough strength, and the film antenna module will not be damaged by the side frame of the back frame.

SUMMARY OF THE INVENTION

Accordingly, the present invention has been made in order to meet such a need described above, and it is an object of the present invention to provide a novel electromagnetic input LCD monitor, wherein the back frame of the electromagnetic input LCD monitor has enough strength, and the film antenna module will not be damaged by the side frame of the back frame.

In order to achieve the above objects, the present invention provides an electromagnetic input LCD monitor. The electromagnetic input LCD monitor includes a back frame and a film antenna module. The back frame has at least one opening. The film antenna module includes a film antenna plate and a signal receiving module. The film antenna plate is disposed on one surface of the back frame; the signal receiving module is disposed on the other surface of the back frame. The film antenna plate has a wiring portion which is connected with the signal receiving module through the opening.

DETAILED DESCRIPTION OF THE INVENTION

The detailed description of the present invention will be discussed in the following embodiments, which are not intended to limit the scope of the present invention, but can be adapted for other applications. While drawings are illustrated in details, it is appreciated that the quantity of the disclosed components may be greater or less than that disclosed, except expressly restricting the amount of the components.

Figure 1A:
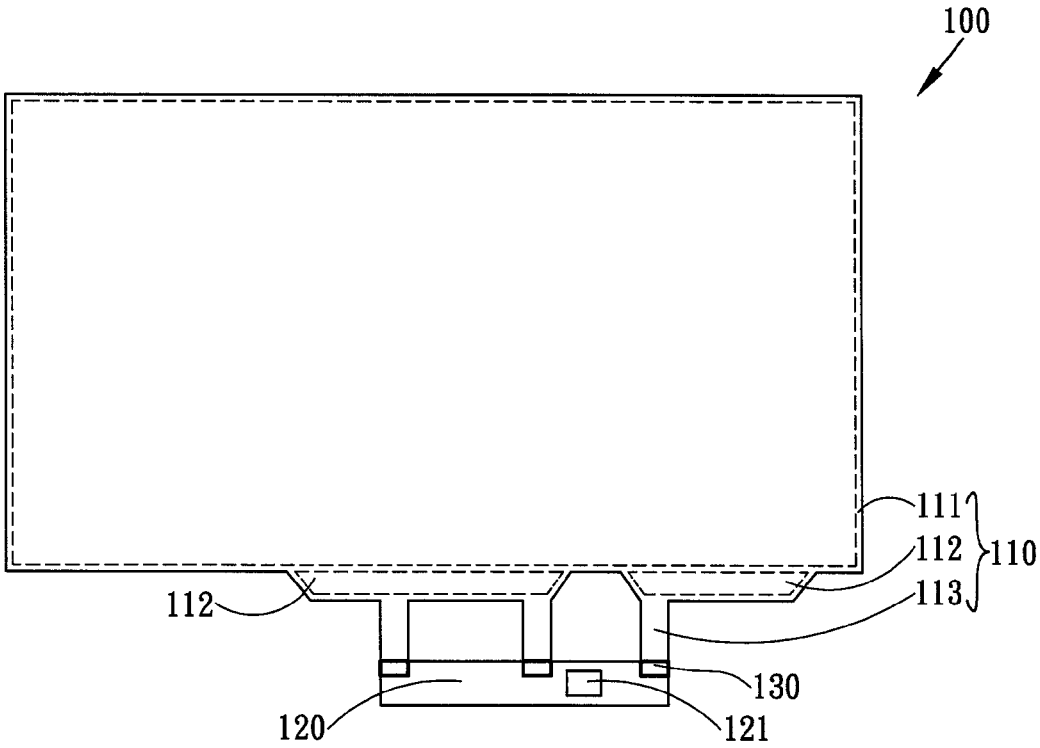
FIG. 1A shows a conventional film antenna module.
Figure 1B:
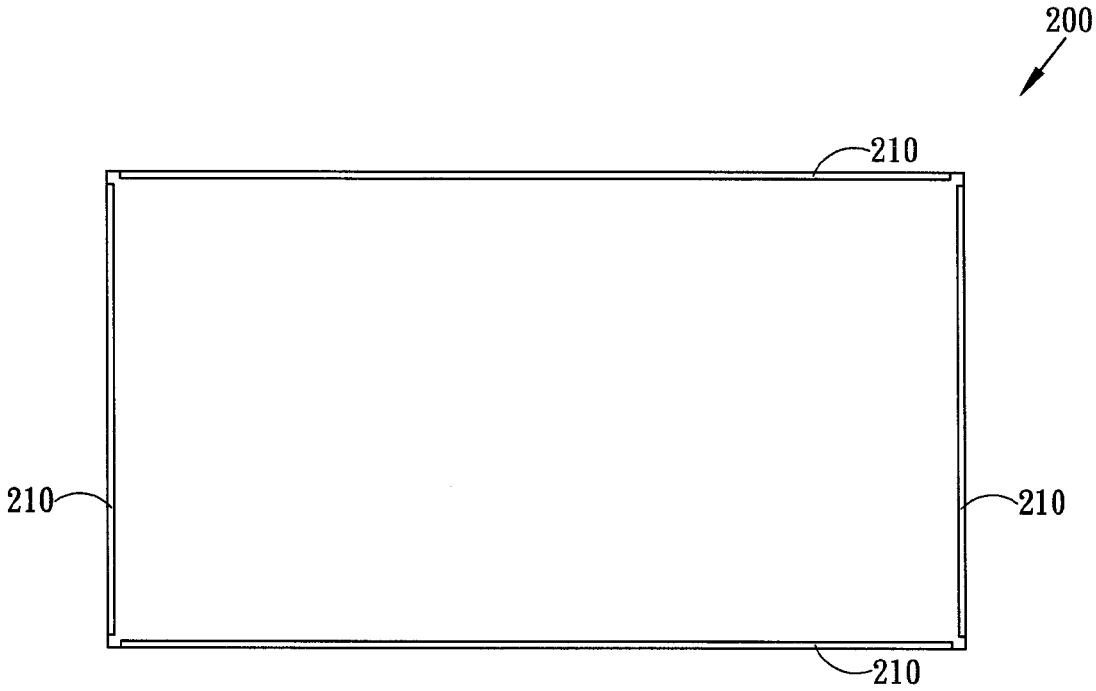
FIG. 1B and FIG. 1C show a rear view and a sectional view of a back frame of a conventional LCD monitor respectively.
Figure 1C:
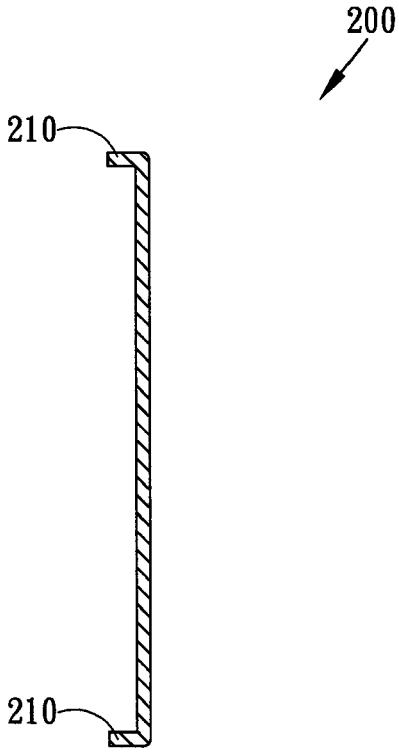
Figure 1D:
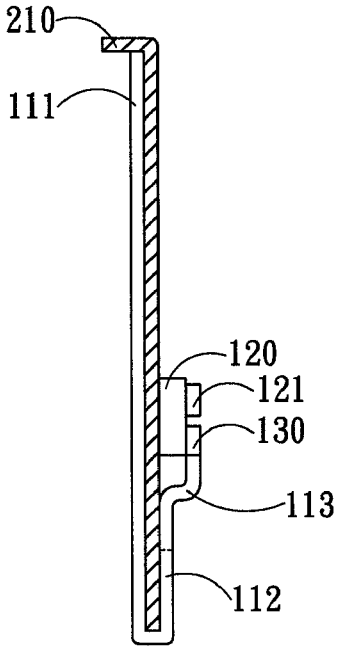
FIG. 1D and FIG. 1E show a sectional view and a rear view of the conventional film antenna module which is disposed on the back frame.
Figure 1E:
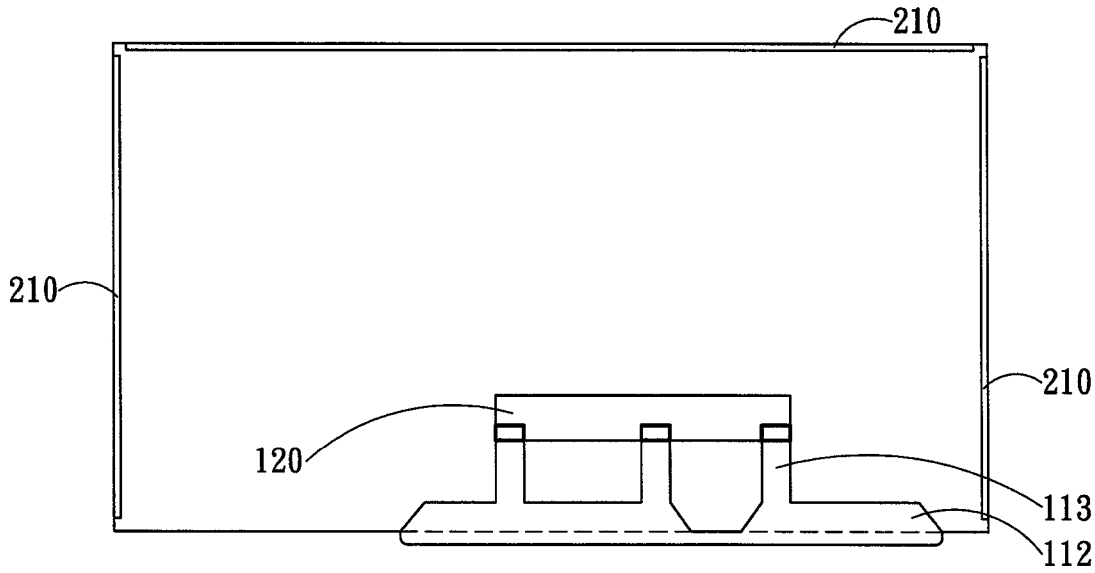
Figure 2A:
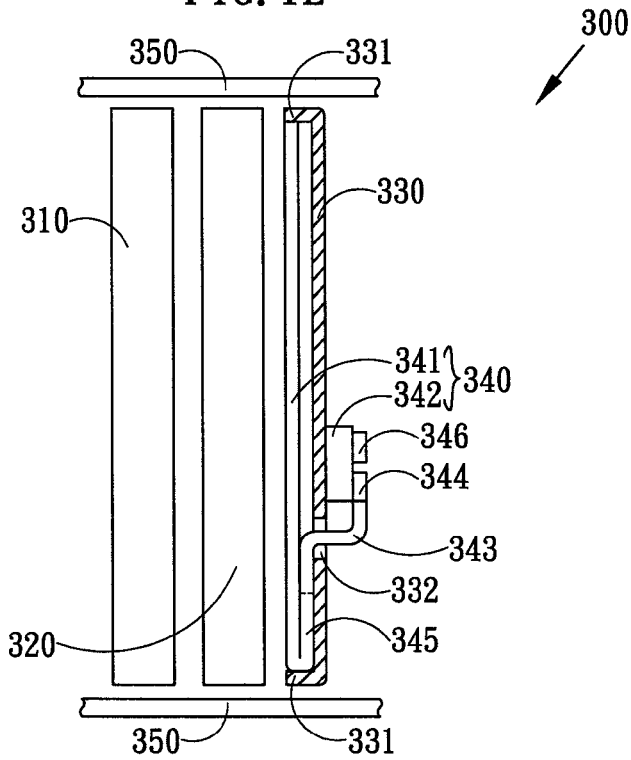
FIG. 2A and FIG. 2B show a sectional view and a rear view of an electromagnetic input LCD monitor 300 in accordance with a preferred embodiment of the present invention.
Figure 2B:
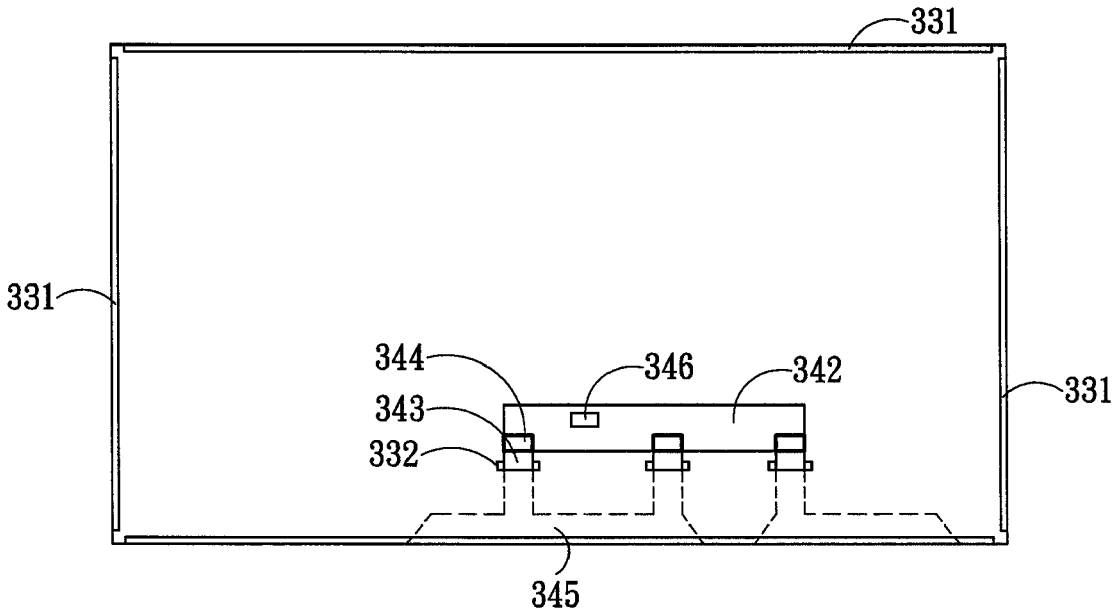

FIG. 2A and FIG. 2B show a sectional view and a rear view of an electromagnetic input LCD monitor 300 in accordance with a preferred embodiment of the present invention. The electromagnetic input LCD monitor 300 includes a liquid crystal module 310, a back light module 320, a back frame 330, a film antenna module 340, and an outer frame 350.

The back frame 330 is disposed in rear of the back light module 320. Side frames 331 are disposed on the edge of the back frame 330. Each side frame 331 is able to be fixed to the outer frame 350 respectively. The back frame 330 has at least one opening 332.

The film antenna module 340 includes a film antenna plate 341 and a signal receiving module 342. The circuit of the film antenna plate 340 is made of silver paste. The film antenna plate 341 is disposed on one surface of the back frame 330, and the signal receiving module 342 is disposed on the other surface of the back frame 330. The film antenna plate 341 has at least one wiring portion 343. The wiring portion 343 passes through the opening 332 and is connected with the signal receiving module 342. The routing area 345 of the film antenna plate 341 is folded and attached to the back frame 330.

Since the wiring portion 343 passes through the opening 332 and is connected with the signal receiving module 342, it is clear that the film antenna module 340 will not be damaged by the side frame 331 of the back frame 330. There is no need to remove any side frame 331 of the back frame 330, and the back frame 330 of the electromagnetic input LCD monitor 300 will have enough strength.

In this embodiment, the wiring portion 343 is connected with the signal receiving module 342 by a connector 344, but not limited to this. The film antenna plate 341 is able to sense an electromagnetic device so as to perform an input process. The signal receiving module 342 includes at least one chip 346 wherein signals of the film antenna plate 341 are processed by the chip 346.

The back frame 330 is able to shield the electromagnetic signals of the back light module 320 so as to prevent the signal receiving module 342 from being interfered by the electromagnetic signals mentioned above. In this embodiment, the back frame 330 is made of aluminum, but not limited to this; the back frame 330 can be made of other metal material which is capable of shielding electromagnetic signals.

Besides, in order to increase the operability of the wiring portion 343 passing through the opening 332, and prevent electromagnetic signals from reaching the signal receiving module 342, the opening 332 must have a proper dimension. In this embodiment, the opening 332 is a rectangular opening, but not limited to this, the opening 332 can be an opening of any other type.

The film antenna plate 341 is designed according to the dimension of the electromagnetic input LCD monitor 300 and some other design considerations. The position of the routing area 345 of the film antenna plate 341 is various for different electromagnetic input LCD monitors, and the position of the opening 332 is not limited to any particular position.

By the electromagnetic input LCD monitor of the present invention, the back frame of the electromagnetic input LCD monitor has enough strength and the film antenna module will not be damaged by the side frame of the back frame.

Although specific embodiments have been illustrated and described, it will be appreciated by those skilled in the art that various modifications may be made without departing from the scope of the present invention, which is intended to be limited solely by the appended claims.

What is claimed is:

1. An electromagnetic input LCD monitor, comprising:

a back frame, said back frame having at least one opening; and a film antenna module, said film antenna module having a film antenna plate and a signal receiving module, said film antenna plate disposed on a surface of said back frame, said signal receiving module disposed on the other surface of said back frame, wherein said film antenna plate has a wiring portion, said wiring portion is connected with said signal receiving module through said opening.

2. The electromagnetic input LCD monitor as claimed in claim 1, wherein said film antenna plate senses an electromagnetic device so as to perform an input process.

3. The electromagnetic input LCD monitor as claimed in claim 1, wherein signals of said film antenna plate are processed by said signal receiving module.

4. The electromagnetic input LCD monitor as claimed in claim 1, wherein said signal receiving module includes at least one chip, signals of said film antenna plate are processed by said chip.

5. The electromagnetic input LCD monitor as claimed in claim 1, wherein said back frame includes at least one side frame, said side frame is disposed on a edge of said back frame, said side frame is fixed on an outer frame of said electromagnetic input LCD monitor.

6. The electromagnetic input LCD monitor as claimed in claim 1, further comprising a back light module, wherein said back light module is disposed at one side of said back frame, said film antenna plate is disposed between said back frame and said back light module.

7. The electromagnetic input LCD monitor as claimed in claim 1, further comprising a liquid crystal module, wherein said liquid crystal module is disposed in front of said back light module.

8. The electromagnetic input LCD monitor as claimed in claim 1, wherein conductive material of said film antenna plate is made of silver paste.

9. The electromagnetic input LCD monitor as claimed in claim 1, wherein said wiring portion is connected with said signal receiving module by a connector.

10. The electromagnetic input LCD monitor as claimed in claim 1, wherein said back frame is made of a metal material.

* * * * *